US007744704B2

(12) United States Patent
Bés et al.

(10) Patent No.: US 7,744,704 B2
(45) Date of Patent: Jun. 29, 2010

(54) HIGH FRACTURE TOUGHNESS ALUMINUM-COPPER-LITHIUM SHEET OR LIGHT-GAUGE PLATE SUITABLE FOR USE IN A FUSELAGE PANEL

(75) Inventors: Bernard Bés, Seyssins (FR); Hervé Ribes, Issoire (FR); Christophe Sigli, Grenoble (FR); Timothy Warner, Voreppe (FR)

(73) Assignee: Alcan Rhenalu, Paris (FR)

( * ) Notice: Subject to any disclaimer, the term of this patent is extended or adjusted under 35 U.S.C. 154(b) by 516 days.

(21) Appl. No.: 11/446,376

(22) Filed: Jun. 5, 2006

(65) Prior Publication Data

US 2008/0289728 A1 Nov. 27, 2008

Related U.S. Application Data

(60) Provisional application No. 60/687,444, filed on Jun. 6, 2005.

(51) Int. Cl.
*C22C 21/12* (2006.01)
*C22F 1/057* (2006.01)

(52) U.S. Cl. ..... 148/417; 148/693; 148/700; 420/533; 420/539

(58) Field of Classification Search ..... 148/417, 148/693, 700; 420/533, 539
See application file for complete search history.

(56) References Cited

U.S. PATENT DOCUMENTS 5,198,045 A 3/1993 Cho
5,389,165 A 2/1995 Cho
5,455,003 A 10/1995 Pickens et al.
7,229,509 B2 * 6/2007 Cho ..... 148/417
2004/0071586 A1 4/2004 Rioja et al.

FOREIGN PATENT DOCUMENTS

| | | |
|---|---|---|
| RU | 2003123027/02 | 9/2004 |
| WO | WO/ 89/01531 | 2/1989 |
| WO | WO 92/20830 | 11/1992 |
| WO | WO 93/23584 | 11/1993 |
| WO | WO 2004/106570 A1 | 12/2004 |

OTHER PUBLICATIONS

Prasad et al, "Mechanical behavior of aluminum- lithium alloys" Sadhana, vol. 28, Parts 1 & 2, 2003, 209-246.

(Continued)

*Primary Examiner*—Roy King
*Assistant Examiner*—Janelle Morillo
(74) *Attorney, Agent, or Firm*—Baker, Donelson, Bearman, Caldwell & Berkowitz PC

(57) ABSTRACT

A low density aluminum based alloy useful in aircraft structure for fuselage sheet or light-gauge plate applications which has high strength, high fracture toughness and high corrosion resistance, comprising 2.7 to 3.4 weight percent Cu, 0.8 to 1.4 weight percent Li, 0.1 to 0.8 weight percent Ag, 0.2 to 0.6 weight percent Mg and a grain refiner such as Zr, Mn, Cr, Sc, Hf, Ti or a combination thereof, the amount of which being 0.05 to 0.13 wt. % for Zr, 0.1 to 0.8 wt. % for Mn, 0.05 to 0.3 wt. % for Cr and Sc, 0.05 to 0.5 wt. % for Hf and 0.05 to 0.15 wt. % for Ti. The amount of Cu and Li preferably corresponds to the formula Cu(wt. %)+5/3 Li(wt. %)<5.2.

34 Claims, 5 Drawing Sheets

OTHER PUBLICATIONS

Kaufman et al. "Kahn- Type Tear Tests and Crack Toughness of Aluminum Alloy Sheet" Materials Research and Standards, Apr. 1964, 151-155.

Lyman et al., "Properties and Selection of Metals" Materials Research & Standards Journal vol. (1), 1961, 241-242.

* cited by examiner

HIGH FRACTURE TOUGHNESS ALUMINUM-COPPER-LITHIUM SHEET OR LIGHT-GAUGE PLATE SUITABLE FOR USE IN A FUSELAGE PANEL

CROSS REFERENCE TO A RELATED APPLICATION

This application claims priority to U.S. Provisional Application No. 60/687,444 filed Jun. 6, 2005, the content of which is incorporated herein by reference in its entirety.

BACKGROUND OF THE INVENTION

1. Field of the Invention

The present invention relates generally to aluminum alloys, and in particular, to such alloys useful in the aerospace industry suitable for use in fuselage applications.

2. Description of Related Art

In today's civil aircraft industry, and in particular for fuselage applications, there is a strong incentive to reduce both weight and cost. The fuselage of a commercial transport aircraft is subject to a complex set of loads, depending on the phase of operation (take-off, cruise, maneuvering, landing . . . ) and environmental conditions (gusts, headwinds, . . . ). Furthermore, different parts of the fuselage are subject to different loadings. In spite of this complexity, it is possible to distinguish major design selection criteria that determine the weight of the structure, some impacting total weight more than others.

For example, compression and shear-compression resistance are extremely important design criteria, since the heaviest fuselage shells are loaded by compression. In order for a new material to allow weight reductions of these compressively loaded shells, this new material should have high Young's modulus, high 0.2% proof stress (to resist buckling) and low density.

A second important design criterion is residual strength of longitudinally cracked shells. Aircraft certification regulations require damage tolerant design, so it is common practice to consider large longitudinal or circumferential cracks in fuselage shells, proving that a certain level of tension can be applied without catastrophic fracture. One known material property governing design here is the plane stress fracture toughness. Any single critical stress intensity factor, however, provides only a limited view of fracture toughness. The development of an R-Curve is a widely recognized method to characterize fracture toughness properties. The R-curve represents the evolution of the stress intensity factor for crack growth as a function of crack extension, under monotonic loading. The R-curve enables the determination of the critical load for unstable fracture for any configuration relevant to cracked aircraft structures. The values of stress intensity factor and crack extension are effective values as defined by ASTM E561. The length of the R-curve—i.e. maximum crack extension of the curve—is an important parameter in itself for fuselage design. The generally employed analysis of conventional tests on center cracked panels gives an apparent stress intensity factor at fracture [$K_{CO}$]. $K_{CO}$ does not vary significantly as a function of R-curve length, especially when the R-curve slope is close to the slope of the curve relating the applied stress intensity factor to the crack length (applied curve). However in a real airframe structure such as a panel with attached stiffeners, when a crack progresses under a non-broken stiffener, the applied curve drops due to the bridging effect of the stiffener. In this case a local minimum of the applied curve can occur for a crack length larger than the initial considered crack length plus crack extension under monotonic loading. As such, larger loads at unstable fracture are then allowed for long R-curves. It is thus of interest to have longer R-curve, even for identical conventionally determined critical stress intensity factors.

For products with identical mechanical properties, lower density is clearly beneficial for air frame weight. A third important design criterion is thus material density. Moreover, large parts of the fuselage are not so heavily loaded and the weight of the design is limited by a certain limit generally called "minimum gauge". The concept of minimum gauge corresponds to the thinnest gauge practicable for manufacturing (particularly handling of panels) and repair (patch riveting). The only way to reduce weight in minimum gauge design is to use a lower density material.

Other important factors affecting material selection include propagation of cracks under fatigue loading, either under constant amplitude loading or with variable amplitude (because of maneuvers and gusts, especially in the longitudinal direction, but also around the wing, in all directions).

Currently, the fuselages of civil aircraft are for the most part made from 2024, 2056, 2524, 6013, 6156 or 7475 alloy sheet or thin plates, clad on either surface with a low composition aluminum alloy, such as a 1050 or 1070 alloy, for example. The purpose of the cladding alloy is to provide sufficient corrosion resistance. Slightly generalized or pitting corrosion is tolerable, but corrosion must not penetrate to attack the core alloy. There is a trend to try using unclad materials for fuselage design, for cost reduction. Corrosion resistance, and particularly resistance to intergranular corrosion and stress corrosion cracking is thus an important aspect of properties of suitable fuselage panels.

As stated above, the only way to reduce weight in some cases is to reduce the density of the materials used for construction of the aircraft. Aluminum-lithium alloys have long been recognized as an effective solution to reduce weight because of the low density of these alloys. However, the different requirements cited above, namely, having a high Young modulus, high compression resistance, high damage tolerance and high corrosion resistance, have not been met simultaneously by prior art aluminum-lithium alloys. In particular, obtaining a high fracture toughness with these alloys has proven to be difficult. Prasad et al, for example, state recently (Sadhana, vol. 28, Parts 1&2, February/April 2003 pp. 209-246) that "Al—Li alloys are prime candidate materials to replace traditionally used Al alloys. Despite their numerous property advantages, low tensile ductility and inadequate fracture toughness, especially in the through thickness-directions, militates against their acceptability". Today, Al—Li alloys have been limited to very specific military applications such as high temperature resistance materials, improved cryogenic fracture toughness materials for aerospace applications, and certain parts in helicopters and military aircraft fuselage parts.

U.S. Pat. No. 5,032,359 (Martin Marietta) describes a family of alloys based upon aluminum-copper-magnesium-silver alloys to which lithium has been added, within specific ranges and which exhibit superior ambient- and elevated-temperature strength, superior ductility at ambient and elevated temperatures, extrudability, forgeability, weldability, and an unexpected natural aging response. The examples describe extruded products. No information is provided on toughness, resistance to fatigue crack or resistance to corrosion. In a preferred embodiment, the alloy includes an aluminum base metal, from 3.0 to 6.5% of copper, from 0.05 to 2.0% of magnesium, from 0.05 to 1.2% of silver, from 0.2 to 3.1% of lithium, from 0.05 to 0.5% of a grain refiner selected from zirconium, chromium, manganese, titanium, boron, hafnium, vanadium, titanium diboride, and mixtures thereof.

U.S. Pat. No. 5,122,339 (Martin Marietta) is a continuation in part of the '359 patent mentioned supra. It additionally discloses the use of similar alloys as welding alloys or weld alloys.

U.S. Pat. No. 5,211,910 (Martin Marietta) describes aluminum-base alloys containing Cu, Li, Zn, Mg and Ag which possess highly desirable properties, such as relatively low density, high modulus, high strength/ductility combinations, strong natural aging response with and without prior cold work, and high artificially aged strength with and without prior cold work. The alloys may comprise from about 1 to about 7 weight percent Cu, from about 0.1 to about 4 weight percent Li, from about 0.01 to about 4 weight percent Zn, from about 0.05 to about 3 weight percent Mg, from about 0.01 to about 2 weight percent Ag, from about 0.01 to about 2 weight percent grain refiner selected from Zr, Cr, Mn, Ti, Hf, V, Nb, B and $TiB_2$, and the balance Al along with incidental impurities. The '910 patent discloses how Zn additions may be used to reduce the levels of Ag present in the alloys taught in U.S. Pat. No. 5,032,359, in order to reduce cost.

U.S. Pat. No. 5,455,003 (Martin Marietta) discloses a method for the production of aluminum-copper-lithium alloys that exhibit improved strength and fracture toughness at cryogenic temperatures. Improved cryogenic properties are achieved by controlling the composition of the alloy, along with processing parameters such as the amount of cold-work and artificial aging. The product is used for cryogenic tanks in space launch vehicles.

U.S. Pat. No. 5,389,165 (Reynolds) discloses an aluminum-based alloy useful in aircraft and aerospace structures which has low density, high strength and high fracture toughness of the following formula: $Cu_aLi_bMg_cAg_dZr_eAl_{bal}$ wherein a, b, c, d, e and bal indicate the amount in wt. % of alloying components, and wherein $2.8<a<3.8$, $0.80<b<1.3$, $0.20<c<1.00$, $0.20<d<1.00$ and $0.08<e<0.46$. Preferably, the copper and lithium components are controlled such that the combined copper and lithium content is kept below the solubility limit to avoid loss of fracture toughness during elevated temperature exposure. The relationship between the copper and lithium contents also should meet the following relationship: Cu(wt. %)+1.5 Li(wt. %)<5.4. Special stretching conditions, between 5 and 11% have been applied. Examples are limited to a thickness of 19 mm and zirconium content superior or equal to 0.13 wt %.

US 2004/0071586 (Alcoa) discloses an Al—Cu—Mg alloy including from 3 to 5 weight percent Cu, from 0.5 to 2 weight percent Mg and from 0.01 to 0.9 weight percent Li. According to this application, toughness properties of alloys having additions of from 0.2 to 0.7 weight percent Li are significantly improved compared to similar alloys containing either no Li or a greater amount of Li.

There is a need for a high strength, high fracture toughness, and especially high crack extension before unstable fracture, high corrosion resistance Al—Li alloy for aircraft applications, and in particular for fuselage sheet applications.

SUMMARY OF THE INVENTION

For these and other reasons, the present inventors arrived at the present invention directed to an aluminum copper, lithium magnesium silver alloy, that exhibits high strength, high toughness, and specifically high crack extension before unstable fracture of wide pre-cracked panels, and high corrosion resistance.

In accordance with these and other objects, the present invention is directed to a rolled, forged and/or extruded aluminum alloy comprising 2.7 to 3.4 wt. % Cu, 0.8 to 1.4 wt. % Li, 0.1 to 0.8 wt. % Ag, 0.2 to 0.6 wt. Mg and at least one grain refiner selected from the group consisting of 0.05 to 0.13 wt. % Zr, 0.05 to 0.8 wt. % Mn, 0.05 to 0.3 wt. % Cr and 0.05 to 0.3 wr % Sc, 0.05 to 0.5 wt. % Hf and 0.05 to 0.15 wt. % for Ti, remainder aluminum and unavoidable impurities, with the additional proviso that the amount of Cu and Li is such that Cu(wt. %)+5/3 Li(wt. %)<5.2.

The instant invention is further directed to methods of making alloys as well as uses and methods thereof.

Additional objects, features and advantages of the invention will be set forth in the description which follows, and in part, will be obvious from the description, or may be learned by practice of the invention. The objects, features and advantages of the invention may be realized and obtained by means of the instrumentalities and combination particularly pointed out in the appended claims.

BRIEF DESCRIPTION OF THE DRAWINGS

The accompanying drawings, which are incorporated in and constitute a part of the specification, illustrate a presently preferred embodiment of the invention, and, together with the general description given above and the detailed description of the preferred embodiment given below, serve to explain the principles of the invention.

FIG. 1: R-curve in the T-L direction (CCT760 specimen).

FIG. 2: R-curve in the L-T direction (CCT760 specimen).

FIG. 3: Evolution of the fatigue crack growth rate in the T-L orientation when the amplitude of the stress intensity factor varies.

FIG. 4: Evolution of the fatigue crack growth rate in the L-T orientation when the amplitude of the stress intensity factor varies.

FIG. 5: R curve in the T-L direction (CCT specimen) of inventive samples obtained with different stretching permanent set.

DETAILED DESCRIPTION OF THE INVENTION

Figure 1:
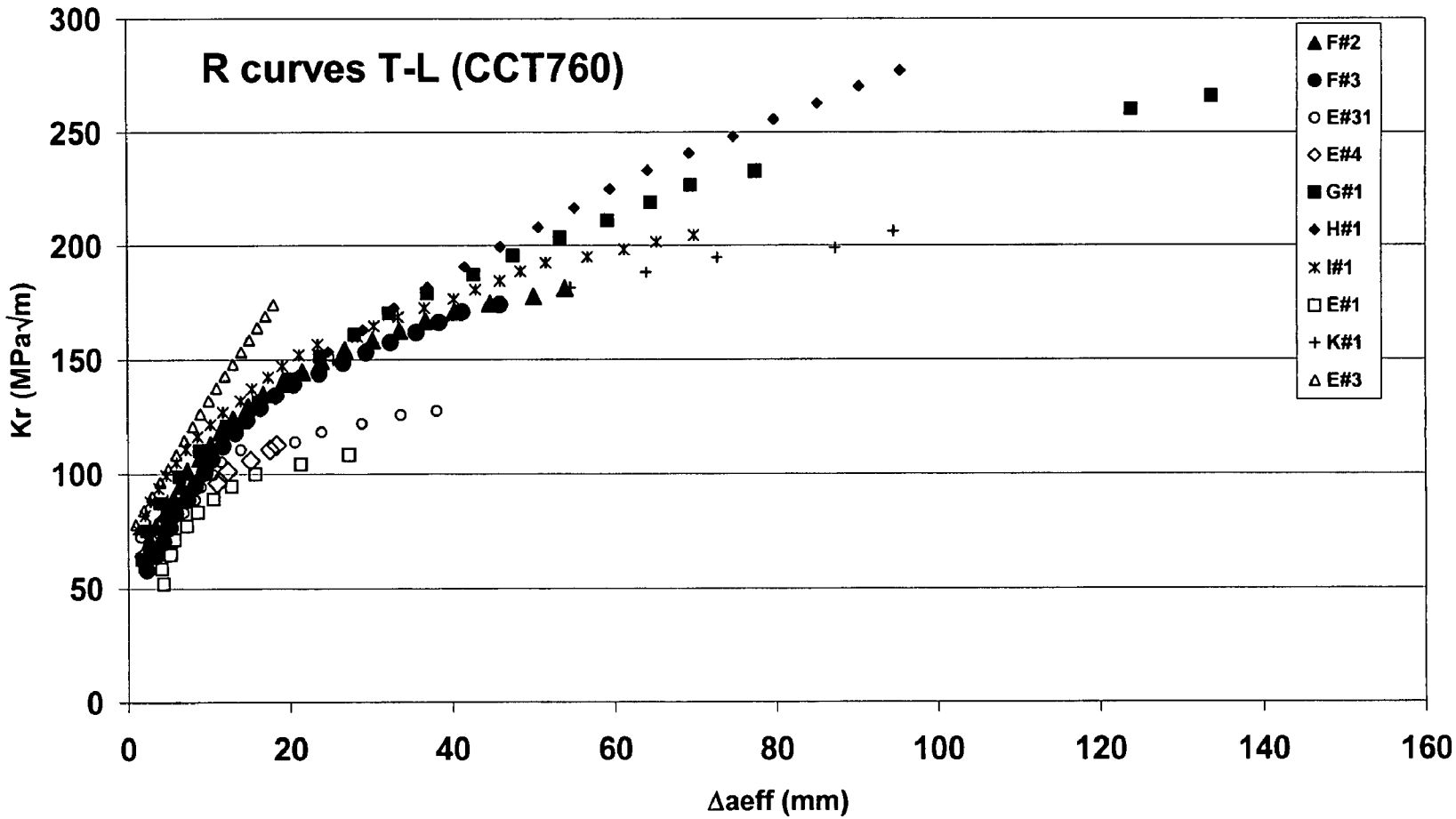
FIGS. 1-5 are directed to certain aspects of the invention as described herein. They are illustrative and not intended as limiting.

Unless otherwise indicated, all the indications relating to the chemical composition of the alloys are expressed as a mass percentage by weight based on the total weight of the alloy. Alloy designation is in accordance with the regulations of The Aluminium Association, known to those skilled in the art. The definitions of tempers are set forth in European standard EN 515, incorporated herein by reference.

Unless mentioned otherwise, static mechanical characteristics, in other words the ultimate tensile strength UTS, the tensile yield stress TYS and the elongation at fracture A, are determined by a tensile test according to standard EN 10002-1, the location at which the pieces are taken and their direction being defined in standard EN 485-1, both of which are incorporated herein by reference.

The fatigue crack propagation rate (using the da/dN test) is determined according to ASTM E 647, incorporated herein by reference. A plot of the stress intensity versus crack extension, known as the R curve, is determined according to ASTM standard E561, incorporated herein by reference. The critical stress intensity factor $K_C$, in other words the intensity factor that makes the crack unstable, is calculated starting from the R curve. The stress intensity factor $K_{CO}$ is also calculated by assigning the initial crack length to the critical load, at the beginning of the monotonous load. These two values are calculated for a test piece of the required shape. $K_{app}$ denotes the $K_{CO}$ factor corresponding to the test piece that was used to make the R curve test. $K_{eff}$ denotes the $K_C$ factor corresponding to the test piece that was used to make the R curve test. $\Delta a_{eff(max)}$ denotes the crack extension of the last valid point of the R curve. Unless otherwise mentioned, the crack size at the end of the fatigue precracking stage is W/3 for test pieces of the M(T) type, wherein W is the width of the test piece as defined in standard ASTM E561. It should be noted that the width of the test panel used in a R curve test can have a substantial influence on the stress intensity measured in the test. Fuselage sheets being large panels, toughness results obtained on wide samples, such as samples with a width of at least 400 mm, are deemed the most significant for toughness performance evaluation. For this reason, only CCT760 test samples, which had a width 760 mm, were used for R curve evaluation in the present invention. The initial crack length 2ao=253 mm.

Toughness was also evaluated in the T-L directions using the global failure energy $E_g$ as derived using the Kahn test. The Kahn stress $R_e$ is equal to the ratio of the maximum load $F_{max}$ that the test piece can resist on the cross section of the test piece (product of the thickness B and the width W). $R_e$ does not allow evaluating the relative toughness of samples with different static mechanical properties. The global failure energy $E_g$ is determined as the area under the Force-Displacement curve as far as the failure of the test piece. The test is described in the article entitled "Kahn-Type Tear Test and Crack Toughness of Aluminum Alloy Sheet" published in the Materials Research & Standards Journal, April 1964, p. 151-155, incorporated herein by reference. For example, the test piece used for the Kahn toughness test is described in the "Metals Handbook", 8th Edition, vol. 1, American Society for Metals, pp. 241-242, incorporated herein by reference.

By "sheet or light-gauge plate" means a rolled product not exceeding 12 mm in thickness.

The term "structural member" refers to a component used in mechanical construction for which the static and/or dynamic mechanical characteristics are of particular importance with respect to structure performance, and for which a structure calculation is usually being prescribed or made. These are typically components the rupture of which may seriously endanger the safety of said mechanical construction, its users or third parties. In the case of an aircraft, said structural members comprise members of the fuselage (such as fuselage skin), stringers, bulkheads, circumferential frames, wing components (such as wing skin, stringers or stiffeners, ribs, spars), empennage (such as horizontal and vertical stabilisers), floor beams, seat tracks, doors.

An aluminum-copper-lithium-silver-magnesium alloy according to one embodiment of the invention advantageously has the following advantageous composition:

TABLE 1

Compositional Ranges of Alloys (wt. %, balance Al)

| | Cu | Li | Ag | Mg |
|---|---|---|---|---|
| Broad | 2.7-3.4 | 0.8-1.4 | 0.1-0.8 | 0.2-0.6 |
| Preferred | 3.0-3.4 | 0.8-1.2 | 0.2-0.5 | 0.2-0.6 |
| Most preferred | 3.1-3.3 | 0.9-1.1 | 0.2-0.4 | 0.2-0.4 |

In order to obtain desired results in terms of fracture toughness according to one embodiment of the present invention, it may be advantageous to obtain a close to perfect or perfect dissolution during solution heat treatment. This will minimize deterioration of toughness during quench. The present inventors have determined that optimizing dissolution can be achieved, for example, by limiting the total quantity of Cu and Li, according to the following relationship between copper and lithium, $$Cu(wt.\ \%)+5/3Li(wt.\ \%)<5.2$$

And/or by guaranteeing a sufficiently high cooling speed during quenching for example, by quenching with cold water.

For some preferred and highly preferred compositions of Table 1, the relationship between copper and lithium is preferentially Cu(wt. %)+5/3 Li(wt. %)<5.

At least one grain refiner or anti-recrystallization element such as Zr, Mn, Cr, Sc, Hf, Ti or a combination thereof is included. Preferred contents of alloying element additions depend on the grain refiner: preferably 0.05 to 0.13 wt. % (more preferred 0.09 to 0.13 wt. %) for Zr, 0.05 to 0.8 wt. % for Mn, 0.05 to 0.3 wt. % for Cr, 0.02 and preferably 0.05 to 0.3 wt. % for Sc, 0.05 to 0.5 wt. % for Hf and 0.01 and preferably 0.05 to 0.15 wt. % for Ti. When more than one anti-recrystallizing element is added, the sum the total content thereof may be limited by the appearance of primary phases.

In an advantageous embodiment, grain refining is achieved with the addition of 0.05 to 0.13 wt. % Zr, 0.02 to 0.3 wt. % Sc and optionally one or more of 0.05 to 0.8 wt. % Mn, 0.05 to 0.3 wt. % Cr, 0.05 to 0.5 wt. % Hf and 0.01 to 0.15 wt. % Ti.

In some instances, and in particular for hot rolled plates with gauges ranging from 4 to 12 mm, it may be advantageous to limit the Mn content to 0.05 wt. % and preferentially to 0.03 wt. %. The present inventors observed that for such gauges, the presence of Mn makes grain structure control more difficult and its presence may affect both static mechanical strength and toughness.

Fe and Si typically affect fracture toughness properties. The amount of Fe should preferably be limited to about 0.1 wt. % and the amount of Si should preferably be limited to about 0.1 wt. % (more preferred 0.05 wt. %). All other elements should also preferably be limited to 0.1 wt. % (more preferred 0.05 wt. %).

The present inventors found that if the copper content is higher than about 3.4 wt. %, the fracture toughness properties may in some cases, rapidly drop. In certain embodiments, it is recommended not to exceed about 3.3 wt. % for Cu content. Advantageously, the copper content is higher than 3.0 wt. % or even 3.1 wt. %.

The present inventors observed that a Zr content higher than about 0.13 wt. % can, in some cases, result in lower fracture toughness performance. Whatever the reason for this drop in fracture toughness, the present inventors have found that higher Zr content resulted in the formation of $Al_3Zr$ primary phases. In this case, a high casting temperature can be used in some cases in order to avoid formation of the primary phases, but such high temperatures may result in lower quality of the liquid metal, in terms of inclusion and gas content. As such, for this and other reasons, the present inventors believe that Zr should advantageously not exceed about 0.13 wt. % in some embodiments.

The inventors found that if the Li content is lower than about 0.8 wt. % or even 0.9 wt. %, the improvement of strength may be too small. In some instances, it may be advantageous if the Li content is >0.9 wt. %. Also, with a low Li concentration (less than about 0.9%), the gain in alloy density may be too limited. Li content higher than 1.4 wt. %, 1.2 wt. % or even 1.1 wt. % significantly reduces the fracture toughness properties. Also a Li concentration of more than 1.4 wt % may present several drawbacks related to thermal stability, castability and material costs.

Addition of Ag is an important feature of the invention. Performances in strength and toughness observed by the inventors are usually difficult to reach for silver free alloys. The present inventors believe that silver has a role during the formation of copper containing strengthening phases formed during natural or artificial aging and in particular, enables the production of finer phases and also produces a more homogeneous distribution of these phases. Advantageous effect of silver is observed when the silver content is higher than 0.1 wt. % and preferentially higher than 0.2 wt. %. Excessive addition of Ag would likely be economically prohibitive in many cases due to silver's high cost, and it is thus advantageous not to exceed 0.5 wt. % or even 0.4 wt. %.

Addition of Mg improves strength and reduces density. Excessive addition of Mg may, however, adversely affect toughness. In an advantageous embodiment, the Mg content is not more than 0.4 wt. %. The present inventors believe that Mg addition may also have role during the formation of copper containing phases.

An alloy according to the invention can be rolled, extruded and/or forged in a product with a thickness advantageously from 0.8 to 12 mm and preferably from 2 to 12 mm.

According to an advantageous embodiment of the present invention, an alloy with controlled amounts of alloying elements is cast as an ingot. The ingot is then preferably homogenized at 490-530° C. for 5 to 60 hours. The present inventors observed that homogenization temperatures higher than about 530° C. may tend to reduce the performance in fracture toughness in some instances.

Before hot-rolling, the ingots are heated at preferably 490-530° C., preferably for 5-30 hours. Hot rolling is carried out to advantageously produce 4 to 12 mm gauge products. For gauges of approximately 4 mm or less, a cold rolling step can be added if desired for any reason. The sheet or light-gauge plate obtained preferably ranges from 0.8 to 12 mm gauge, or even from 2 to 12 mm and the present invention is more advantageous for 2 to 9 mm gauge products and even more advantageous for 3 to 7 mm gauge products. The sheets or light-gauge plates are then solution heat treated, for example, by soaking at 490 to 530° C. for 15 min to 2 hours and quenched with water that is not more than room temperature, or preferentially with cold water.

The product is then preferably stretched from 1 to 5% and preferentially from 2.5 to 4%. Such levels of cold working may also be obtained by cold rolling, levelling, forging, and/or a combination thereof with stretching. Advantageously the total cold working deformation after quenching is from 2.5 to 4%. In particular, when a levelling step is carried out between quenching and stretching and no other cold working step is carried out, it may be advantageous if the stretching permanent set is from 1.7 to 3.5%. The present inventors have observed that fracture toughness tends to decrease if a stretching with a permanent set of more than about 5% is applied. In addition, the Kahn test results, especially $E_g$, tends to decrease above 5% permanent set. It is therefore advisable not to exceed 5% permanent set. Moreover, if the stretching is higher than 5%, industrial difficulties such as a high ratio of defective parts or difficult forming could be encountered, which in turn, increases the cost of the product Aging is advantageously carried out at 140-170° C. for 5 to 30 h, which results in a T8 temper. In some instances, and particularly for some preferred and most preferred compositions of Table 1, aging is more preferentially carried out at 140-155° C. for 10-30 h. Lower aging temperatures generally favor high fracture toughness. In one embodiment of the present invention, the aging step is divided into two steps: a pre-aging step prior to a welding operation, and a final heat treatment of a welded structural member.

Sheet or light-gauge plates of the present invention have advantageous properties for recrystallized, unrecrystallized or mixed (containing both recrystallized and unrecrystallized zones) microstructures. In some instances, it can be advantageous to avoid mixed microstructures. For example, for sheet or light-gauge slabs with gauges ranging from 4 to 12 mm, it may be advantageous if the microstructure is completely unrecrystallized.

Some advantageous characteristics of products of the present invention include one or more of the following in a T8 temper:

The tensile yield strength is preferably at least 440 MPa, even 450 MPa or even better 460 MPa in the L-direction.

The ultimate tensile strength is preferably at least 470 MPa, even 480 MPa or even better 490 MPa in the L-direction.

The fracture toughness properties using CCT760 (2ao=253 mm) specimens are such as:

$K_{app}$ in T-L direction is preferably at least 110 MPa√m and preferentially at least 130 MPa√m or even 140 MPa√m;

$K_{app}$ in L-T direction is at least 150 MPa√m and preferentially at least 170 MPa√m;

$K_{eff}$ in T-L direction is at least 130 MPa√m and preferentially at least 150 MPa√m;

$K_{eff}$ in L-T direction is at least 170 MPa√m or even 190 MPa√m and preferentially at least 230 MPa√m;

$\Delta a_{eff\,(max)}$, the crack extension of the last valid point of the R-curve in T-L direction is preferably at least 30 mm and preferentially at least 40 mm;

$\Delta a_{eff\,(max)}$ from R-curve in L-T direction is preferably at least 50 mm.

Forming of a sheet or light-gauge plate of the present invention may advantageously be made by deep drawing, pressing, fluoturning, rollforming and/or bending, these techniques as well as others being known to persons skilled in the art. For assembly of a structural part, any known and possible techniques including riveting and welding techniques suitable for aluminum alloys can be used if desired.

Sheets or light-gauge plates of the present invention may be fixed to stiffeners or frames, for example, by riveting or welding. The present inventors have found that if welding is chosen, it may be preferable to use low heat welding techniques, which helps ensure that the heat affected zone is as small as possible. In this respect, laser welding and/or friction stir welding often give particularly satisfactory results. Within the scope of the invention, friction stir welding is a preferred welding technique. Welded joints of sheet or light gauge plates according to the present invention, advantageously obtained by friction stir welding, exhibit a joint efficiency factor higher than 70% and preferentially higher than 75%. This advantageous result can be obtained, for example, when aging is carried out after welding as well as when aging is carried out before welding.

Rolled, forged and/or extruded aluminum alloy of the invention can advantageously comprised in structural members. A structural member formed of sheet or light-gauge plate according to the present invention can include, for example, stiffeners or frames. Stiffeners or frames are preferably made of extruded profiles, and may be used in particular for airplane fuselage construction as well as any other use where the instant properties could be advantageous.

A sheet or light-gauge plate of the present invention has particularly favorable static mechanical properties and a high fracture toughness. For known products, sheet or light-gauge plates having high fracture toughness, generally have low tensile and yield strengths. For sheets or light-gauge plates of the present invention, the high mechanical properties favor industrial applications such as for aircraft structural parts, and the tensile strength and yield strength of sheets or light-gauge plate materials of the present invention are characteristics that are directly taken into account for the calculation of structural dimensioning. Calculations of structural assemblies skin/stringer with sheet or light-gauge plates according to the invention, in particular for fuselage applications, showed a possibility of weight reduction when compared with the equivalent structural assemblies skin/stringer made with prior art sheet or light-gauge plates. Such weight reductions can in some embodiments be from 1-10% and in some cases even higher weight reductions can be achieved.

As an example, for a structural element of given dimensions, substitution of 2024 alloy by an alloy according to the invention, without using the improved mechanical properties to redesign the structural member, enables a weight reduction of 3 to 3.5%. High mechanical strength of alloy products according to the present invention enable the development of structural elements with dimensions and designs that are even lighter, and as such, a weight reduction of 10% or even higher can be reached in some instances.

Sheet or light-gauge plates of the present invention generally do not raise any particular problems during subsequent surface treatment operations conventionally used in aircraft manufacturing.

Resistance to intergranular corrosion of the sheet or light-gauge plate of the present invention is generally high. For example, typically, only pitting is detected when the metal is submitted to corrosion testing according to ASTM G110. In a preferred embodiment of the present invention, a sheet or light-gauge plate can be used without cladding on either surface with a low composition aluminum alloy if desired.

These as well as other aspects of the present invention are explained in more detail with regard to the following illustrative and non-limiting examples:

EXAMPLES

Example 1

In connection with the present invention, several known materials are presented for comparison purposes (reference A to E). They include 2024, 2056, 7475, 6156 and 2098, alloys. Examples from the invention are labeled F to K. The chemical composition of the various alloys tested is provided in Table 2.

TABLE 2

| Cast reference | Chemical composition (weight %) | | | | | | | | | | |
|---|---|---|---|---|---|---|---|---|---|---|---|
| | Si | Fe | Cu | Mn | Mg | Cr | Zn | Zr | Li | Ag | Ti |
| A (2024) | 0.12 | 0.15 | 4.2 | 0.5 | 1.4 | 0.05 | 0.2 | 0.02 | — | — | 0.02 |
| B (2056) | 0.06 | 0.09 | 4.0 | 0.4 | 1.3 | — | 0.6 | — | — | — | 0.02 |
| C (7475) | 0.04 | 0.07 | 1.6 | 0.01 | 2.2 | 0.2 | 5.8 | 0.02 | — | — | 0.02 |
| D (6156) | 0.78 | 0.07 | 0.9 | 0.45 | 0.75 | — | 0.14 | 0.02 | — | — | 0.02 |
| E (2098) | 0.03 | 0.04 | 3.6 | 0.01 | 0.32 | — | — | 0.14 | 1.00 | 0.33 | 0.02 |
| F | 0.02 | 0.04 | 3.3 | 0.01 | 0.31 | — | — | 0.12 | 0.96 | 0.32 | 0.02 |
| G | 0.05 | 0.06 | 3.2 | 0.01 | 0.31 | — | — | 0.11 | 0.93 | 0.32 | 0.03 |
| H | 0.05 | 0.06 | 3.3 | 0.02 | 0.31 | — | 0.06 | 0.11 | 0.96 | 0.34 | 0.02 |
| I | 0.05 | 0.06 | 3.2 | 0.01 | 0.31 | — | — | 0.11 | 0.94 | 0.33 | 0.03 |
| J | 0.03 | 0.04 | 3.2 | — | 0.31 | — | — | 0.11 | 0.98 | 0.33 | 0.02 |
| K | 0.03 | 0.04 | 3.3 | 0.00 | 0.31 | — | — | 0.11 | 0.97 | 0.34 | 0.03 |

The density of the different alloys tested is presented in Table 3. Samples F to K exhibit the lowest density of the different materials tested.

TABLE 3

| Density of the alloys tested | |
|---|---|
| Reference | Density ($g/cm^3$) |
| A (2024) | 2.78 |
| B (2056) | 2.78 |
| C (7475) | 2.81 |
| D (6156) | 2.72 |
| E (2098) | 2.70 |
| F, G, H, I, J, K | 2.69 |

The process used for the manufacture of the reference samples A to D was the conventional industrial process known to those of skill in the art. Reference samples A to D were cladded products. The final tempers for A, B, C and D were, respectively, T3, T3, T76 and T6 according to EN573. The process used to manufacture samples E and F is presented in Table 4. In some instances, a levelling step was carried out between quenching and stretching. E samples were not transformed with their most usual conditions, which include a stretching operation with an elongation between 5 and 10%, for comparison purposes. For sample E#3 an annealing was carried out before solution heat treating in order to try to improve toughness. However, such a special transformation sequence including one additive step would generally not be favored industrially because of the cost increase it would generate. For samples E#1, E#2, E#31 and E#4 no intermediate annealing was carried out.

TABLE 4

| Conditions of the consecutive steps of transformation | | | |
|---|---|---|---|
| | Reference E | References F and K | References G, H, I, J |
| Temper | T8 | T8 | T8 |
| Stress relieving by heating | Yes | Yes | Yes |
| Homogenizing | 8 h at 500° C. + 36 h at 526° C. | 8 h at 500° C. + 36 h at 526° C. | 12 h 505° C. |
| Pre-heating before hot rolling | 20 h at 520° C. | 20 h at 520° C. | 20 h at 520° C. |
| Hot rolling | Thickness > 4 mm | Thickness > 4 mm | Thickness > 4 mm |
| Cold rolling | Thickness < 4 mm | Thickness < 4 4mm | Thickness < 4 mm |
| Solution heat treating | 2 h at 521° C. | 1 h at 517° C. | 30 mn at 505° C. |
| Quenching | Cold water | Cold water | Cold water |
| Stretching | 1-5% permanent set | 1-5% permanent set | 1-5% permanent set |
| Aging | 14 h at 155° C. (thickness < 5 mm) 18 h at 160° C. (thickness 6.7 mm) | 14 h at 155° C. | 14 h at 155° C. |

For samples G, H, I and J, the precise composition selection enables a complete dissolution while the solution heat treating temperature remains significantly lower than the solidus.

After aging, the samples were cut to the desired dimensions. Table 5 provides the reference of the different samples and their dimensions.

TABLE 5

| Final dimensions of the samples | | | |
|---|---|---|---|
| Sample | Thickness [mm] | Width [mm] | Length [mm] |
| A | 6.0 | 2000 | 3000 |
| B | 6.0 | 2000 | 3000 |
| C | 6.3 | 1900 | 4000 |
| D | 4.6 | 2500 | 4500 |
| E#1 | 2.0 | 1000 | 2500 |
| E#2 | 3.2 | 1000 | 2500 |
| E#3 | 4.5 | 1250 | 2500 |
| E#31 | 4.5 | 1250 | 2500 |
| E#4 | 6.7 | 1250 | 2500 |
| F#1 | 3.0 | 1000 | 2500 |
| F#2 | 5.0 | 1250 | 2500 |
| F#3 | 6.7 | 1250 | 2500 |
| G#1 | 3.8 | 2450 | 9600 |
| H#1 | 5.0 | 2450 | 9600 |
| I#1 | 5.0 | 1500 | 3000 |
| K#1 | 2.0 | 1000 | 2500 |

The samples were mechanically tested to determine their static mechanical properties as well as their toughness. Tensile yield strength, ultimate strength and elongation at fracture are provided in Table 6.

TABLE 6

| Mechanical properties of the samples | | | | | | | |
|---|---|---|---|---|---|---|---|
| | | L Direction | | | LT Direction | | |
| Sample | Thickness | UTS (MPa) | TYS (MPa) | E (%) | UTS (MPa) | TYS (MPa) | E (%) |
| A | 6.0 | 454 | 367 | 19.0 | 448 | 323 | 19.3 |
| B | 6.0 | 460 | 367 | 20.0 | 450 | 325 | 21.0 |
| C | 6.3 | 510 | 450 | 14.0 | 506 | 460 | 11.5 |
| D | 4.6 | 374 | 356 | 12.0 | 375 | 339 | 12.0 |
| E#1 | 2.0 | 532 | 514 | 9.9 | 538 | 490 | 10.6 |
| E#3 | 4.5 | 586 | 570 | 11.0 | 568 | 543 | 12.0 |

TABLE 6-continued

| Mechanical properties of the samples | | | | | | | |
|---|---|---|---|---|---|---|---|
| | | L Direction | | | LT Direction | | |
| Sample | Thickness | UTS (MPa) | TYS (MPa) | E (%) | UTS (MPa) | TYS (MPa) | E (%) |
| E#31 | 4.5 | 571 | 539 | 10.2 | 565 | 522 | 11.3 |
| E#4 | 6.7 | 560 | 540 | 12.0 | 557 | 531 | 11.7 |
| F#1 | 3.0 | 490 | 469 | 13.0 | 512 | 467 | 12.5 |
| F#2 | 5.0 | 498 | 470 | 12.2 | 502 | 453 | 11.1 |
| F#3 | 6.7 | 514 | 481 | 12.2 | 509 | 468 | 11.6 |
| G#1 | 3.8 | 507 | 470 | 11.3 | 494 | 447 | 13.8 |
| H#1 | 5.0 | 517 | 478 | 11.9 | 488 | 444 | 14.7 |
| I#1 | 5.0 | 493 | 458 | 8.7 | 483 | 431 | 11.0 |
| K#1 | 2.0 | 508 | 481 | 12.6 | 496 | 439 | 13.0 |

The static mechanical properties of the samples according to the invention are very high compared to a conventional damage tolerant 2XXX series alloy, in the range of the 7475 T76 sample referenced C. The strength of the samples according to the invention was slightly lower than the strength of reference E alloy. The inventors believe that the lower copper content and the lower zirconium content of the samples according to the present invention influenced slightly the strength of the samples according to the invention.

Figure 2:
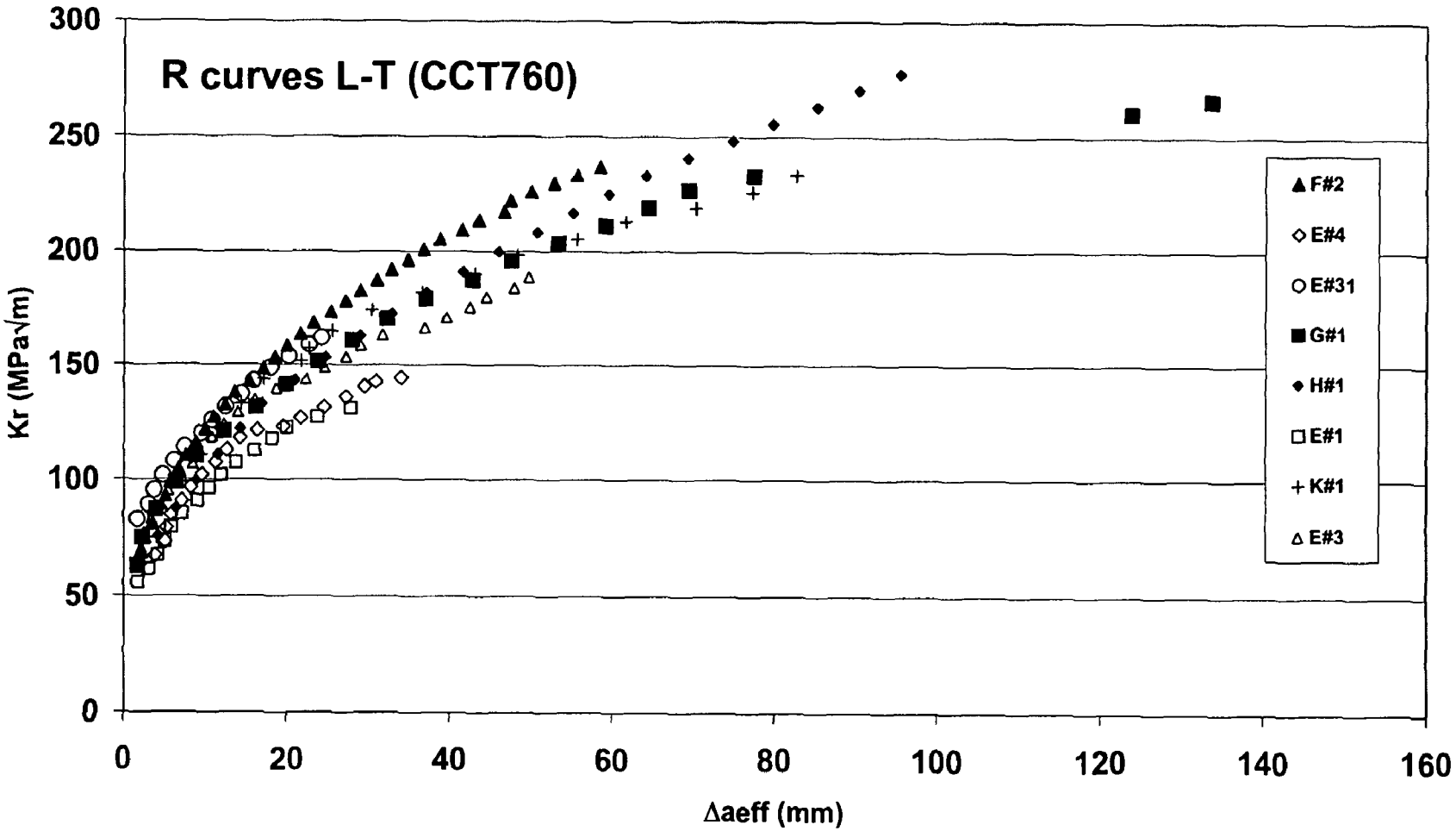

R-curves of some samples from the invention and reference 2098 samples are provided in FIGS. 1 and 2, for T-L and L-T directions, respectively. FIG. 1 clearly shows that the crack extension of the last valid point of the R-curve ($\Delta a_{eff(max)}$) is much larger for samples from the invention than for reference samples E#1, E#3, E#31 and E#4. This parameter is at least as critical as the $K_{app}$ values because, as explained in the description of related art, the length of the R-curve is an important parameter for fuselage design. FIG. 2 shows the same trend, eventhough the L-T direction intrinsically gives better results. The R-curve of sample F#3 could not be measured in the L-T direction because the maximum load of the machine was reached. Table 7 summarizes the results of toughness tests. Plates from the invention exhibit a $K_{app}$ value in the T-L direction higher than 110 MPa√m and even higher than 130 MPa√m whereas 2098 reference sample exhibit a $K_{app}$ value in the T-L direction lower than 110 MPa√m except for sample E#3 which underwent a special annealing step before solution heat treatment.

TABLE 7

Results of toughness tests (R-curve).

| Sample | Thickness [mm] | T-L (760 mm wide specimen) $K_{app}$ (MPa√m) | T-L (760 mm wide specimen) $K_{eff}$ (MPa√m) | L-T (760 mm wide specimen) $K_{app}$ (MPa√m) | L-T (760 mm wide specimen) $K_{eff}$ (MPa√m) |
|---|---|---|---|---|---|
| A | 6.0 | 114 | 160 | 130 | 180 |
| B | 6.0 | 140 | 220 | 150 | 236 |
| C | 6.3 | 110 | 135 | 150 | 206 |
| D | 4.6 | 125 | 178 | 147 | 214 |
| E#1 | 2.0 | 95 | 108 | 114 | 131 |
| E#2 | 3.1 | 104 | 114 | 160 | 200 |
| E#3 | 4.5 | 154 | 174 | 148 | 188 |
| E#31 | 4.5 | 106 | 126 | 143 | 162 |
| E#4 | 6.7 | 103 | 112 | 123 | 143 |
| F#2 | 5.0 | 141 | 171 | 179 | 237 |
| F#3 | 6.7 | 140 | 171 | 155 | 172 |
| G#1 | 3.8 | 162 | 227 | 164 | 213 |
| H#1 | 5.0 | 175 | 277 | 154 | 191 |
| I#1 | 5.0 | 150 | 192 | | |
| K#1 | 2.0 | 140 | 182 | 158 | 213 |

The results originating from the R-curve are grouped together in Table 8. Crack extension of the last valid point of the R-curve is higher for inventive samples than for reference samples. Indeed, in the T-L direction, all inventive samples reach a crack extension of at least 30 mm and even 40 mm whereas maximum crack extension was always lower that 40 mm for reference samples. The inventors believe that several reasons can be proposed to explain this performance, including low Cu content, low Zr content, limited stretching and limited aging temperature.

Resistance to intergranular corrosion of the samples was tested according to ASTM G110. For each inventive sample, no intergranular corrosion was detected. No intergranular corrosion was detected either for 2098 reference samples (E#1 to E#4). For sample B (decladded), intergranular corrosion was observed with an average depth of 120 μm and for sample D (decladded), intergranular corrosion was observed with an average depth of 180 μm. Resistance to intergranular corrosion was, thus, high for the samples according to the invention.

TABLE 8

R-curve summary data

| | | Δa [mm] 10 | 20 | 30 | 40 | 50 | 60 | 70 | 80 |
|---|---|---|---|---|---|---|---|---|---|
| $K_r$ (T-L direction) [Mpa√m] | E#1 | 86 | 106 | | | | | | |
| | E#3 | 125 | 161 | | | | | | |
| | E#31 | 97 | 112 | 123 | | | | | |
| | E#4 | 96 | | | | | | | |
| | F#2 | 113 | 141 | 159 | 170 | 178 | | | |
| | F#3 | 104 | 136 | 156 | 168 | | | | |
| | G#1 | 115 | 146 | 167 | 184 | 198 | 210 | 221 | 230 |
| | H#1 | 106 | 140 | 166 | 188 | 207 | 225 | 241 | 256 |
| | I#1 | 122 | 147 | 164 | 177 | 188 | 198 | | |
| | K#1 | 113 | 139 | 156 | 168 | 178 | 186 | 192 | 198 |
| $K_r$ (L-T direction) [MPa√m] | E#1 | 96 | 120 | | | | | | |
| | E#3 | 115 | 141 | 159 | 174 | 185 | | | |
| | E#31 | 123 | 152 | | | | | | |
| | E#4 | 102 | 128 | 140 | | | | | |
| | F#2 | 122 | 159 | 185 | 206 | 225 | | | |
| | G#1 | 123 | 153 | 173 | 189 | 203 | 214 | 224 | 233 |
| | H#1 | 124 | 150 | 168 | 182 | 193 | 203 | 212 | 220 |
| | K#1 | 115 | 149 | 171 | 188 | 201 | 212 | 221 | 228 |

Figure 3:
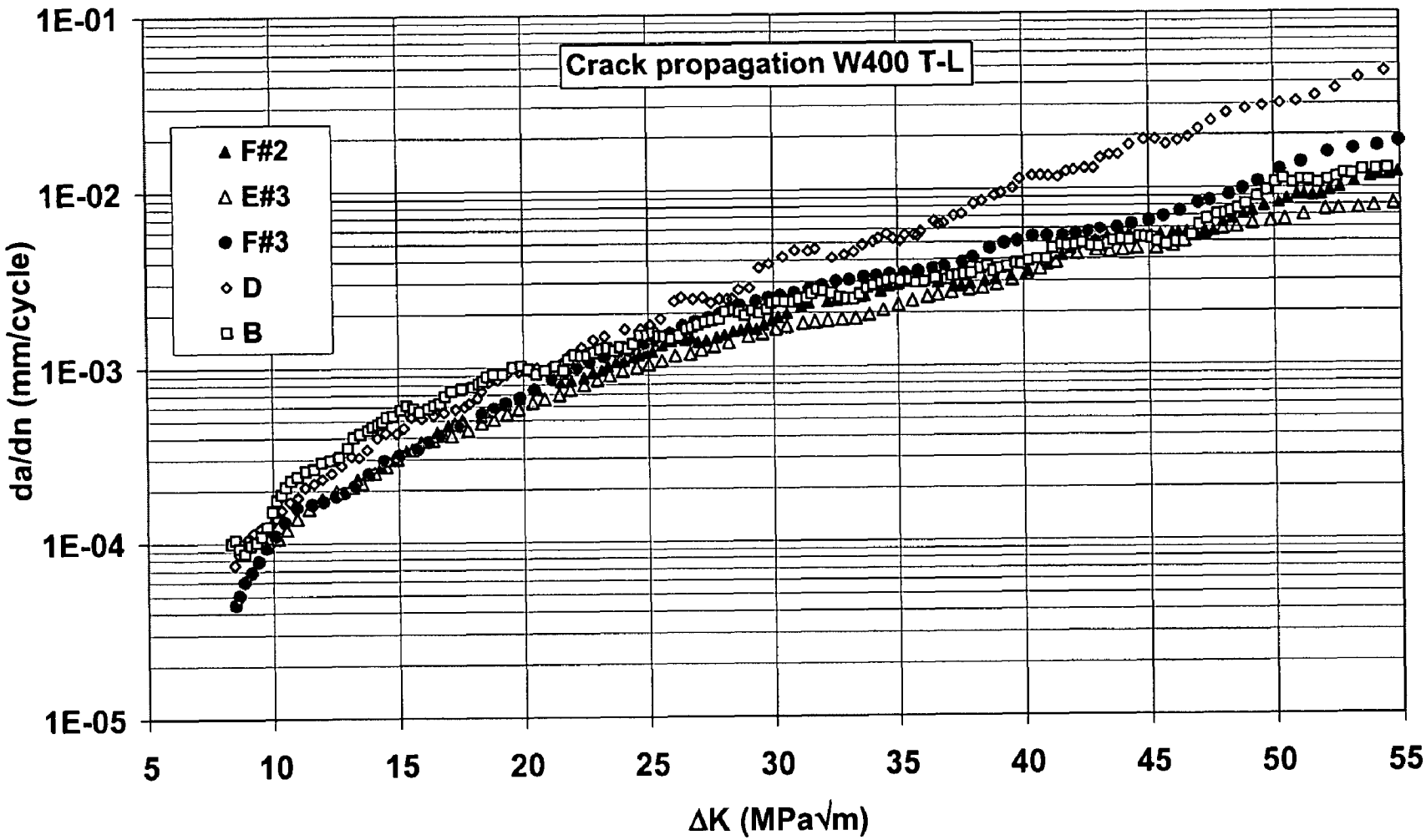
Figure 4:
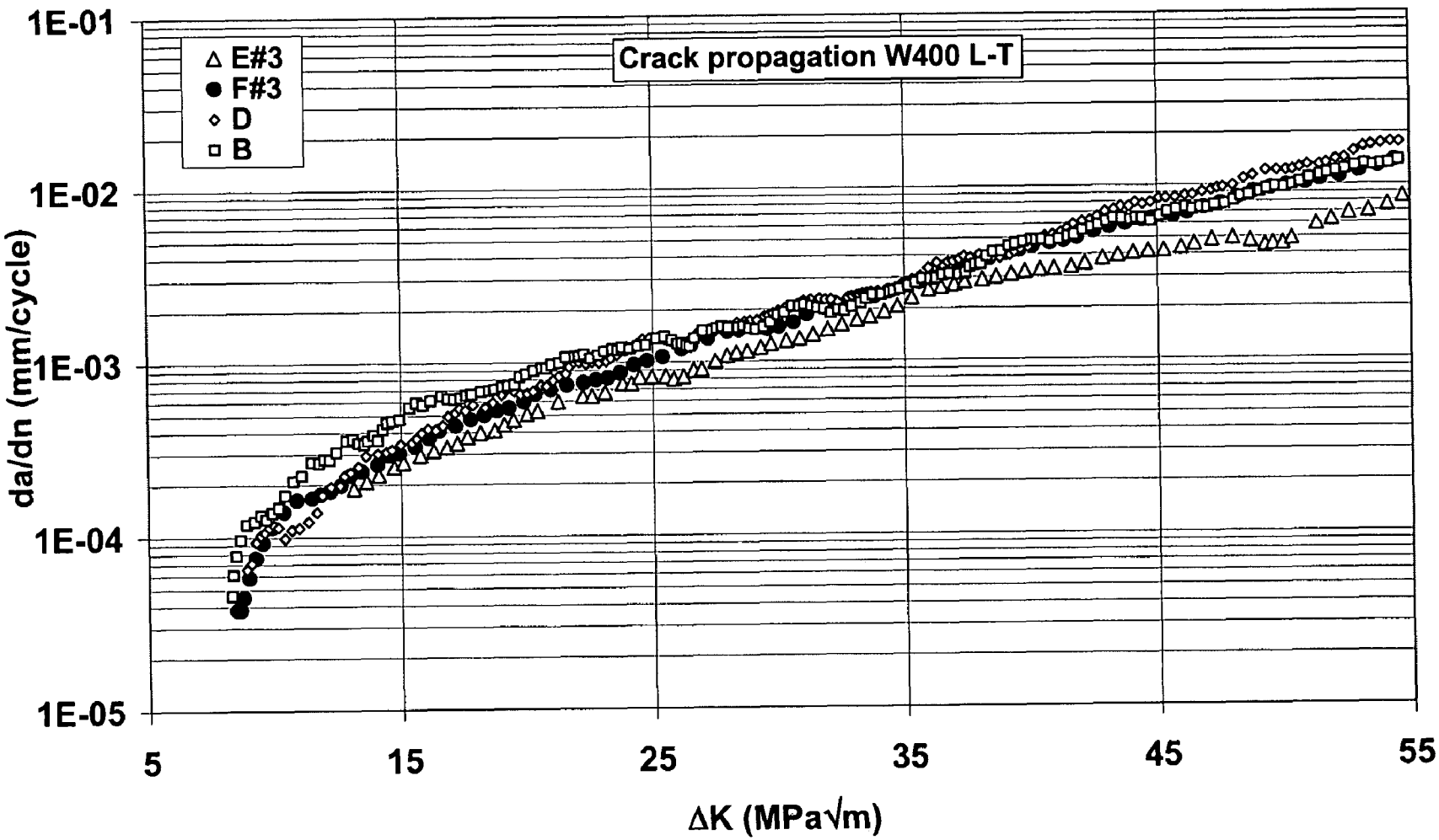

FIGS. 3 and 4 show the evolution of the fatigue crack growth rate in the T-L and L-T orientation, respectively, when the amplitude of the stress intensity factor varies. The width of sample was 400 mm (CCT 400 specimen) and R=0.1. No major difference is observed between samples E and F. Sample F fatigue crack propagation rate is on the same range as values obtained for 2056 alloy (sample B) and lower than values obtained for 6156 alloy (sample D).

Example 2

In this example, the influence of stretching was investigated on laboratory samples. Six samples from cast H and transformed to 5 mm thick plates according to the conditions listed in Table 4 were stretched with a permanent set ranging from 1 to 6% and aged 18 h at 155° C. The samples were mechanically tested to determine their static mechanical properties as well as their toughness. Tensile yield strength, ultimate strength and elongation at fracture are provided in Table 9.

TABLE 9

Mechanical properties of laboratory samples with varying stretch

| Sample | Stretching (%) | L Direction UTS (MPa) | L Direction TYS (MPa) | L Direction E (%) | LT Direction UTS (MPa) | LT Direction TYS (MPa) | LT Direction E (%) |
|---|---|---|---|---|---|---|---|
| H#11 | 1 | 495 | 436 | 11.2 | 469 | 411 | 15.1 |
| H#12 | 2 | 515 | 469 | 11.1 | 489 | 444 | 13.5 |
| H#13 | 3 | 529 | 493 | 10.5 | 501 | 464 | 13.8 |
| H#14 | 4 | 534 | 501 | 10.8 | 501 | 465 | 14.2 |
| H#15 | 5 | 542 | 514 | 10.8 | 511 | 481 | 13.8 |
| H#16 | 6 | 550 | 524 | 10.4 | 516 | 485 | 13.9 |

Static mechanical properties increase with increasing stretching. Most of the increase in strength is reached with 3% stretching. Indeed, the increase of UTS(L) is 7% from 1 to 3% stretching whereas it is only 3% from 4 to 6% stretching. Toughness was evaluated according to the Kahn test method, and the results are provided in Table 10.

TABLE 10

Kahn test results of laboratory samples with varying stretch.

| Sample | Stretching (%) | Kahn test $E_g$ (J) |
|---|---|---|
| H#11 | 1 | 30.5 |
| H#12 | 2 | 29.2 |
| H#13 | 3 | 27.8 |
| H#14 | 4 | 25.1 |
| H#15 | 5 | 25.0 |
| H#16 | 6 | 20.6 |

The relationship between $E_g$ and toughness is direct although these values cannot be used to predict R-curve results of wide samples because the different geometry. It is noticeable that $E_g$ decreases slowly until a stretching of 5% and decreases more abruptly with a stretching of 6%.

Example 3

In this example, the influence of stretching was investigated on industrial samples. Three samples from cast J and transformed to 5 mm thick plates according to the conditions listed in Table 4 were leveled and stretched with a permanent set of 1.8 and 3.4%. The samples were mechanically tested to determine their static mechanical properties as well as their toughness. Tensile yield strength, ultimate strength and elongation at fracture are provided in Table 11.

TABLE 11

Mechanical properties of industrial samples with varying stretch.

| Sample | Stretching (%) | L Direction UTS (MPa) | L Direction TYS (MPa) | L Direction E (%) | LT Direction UTS (MPa) | LT Direction TYS (MPa) | LT Direction E (%) |
|---|---|---|---|---|---|---|---|
| J#11 | 1.8 | 510. | 465. | 13.1 | 495. | 444. | 14.5 |
| J#12 | 3.4 | 534. | 499. | 10.7 | 515. | 475. | 13.7 |

Figure 5:
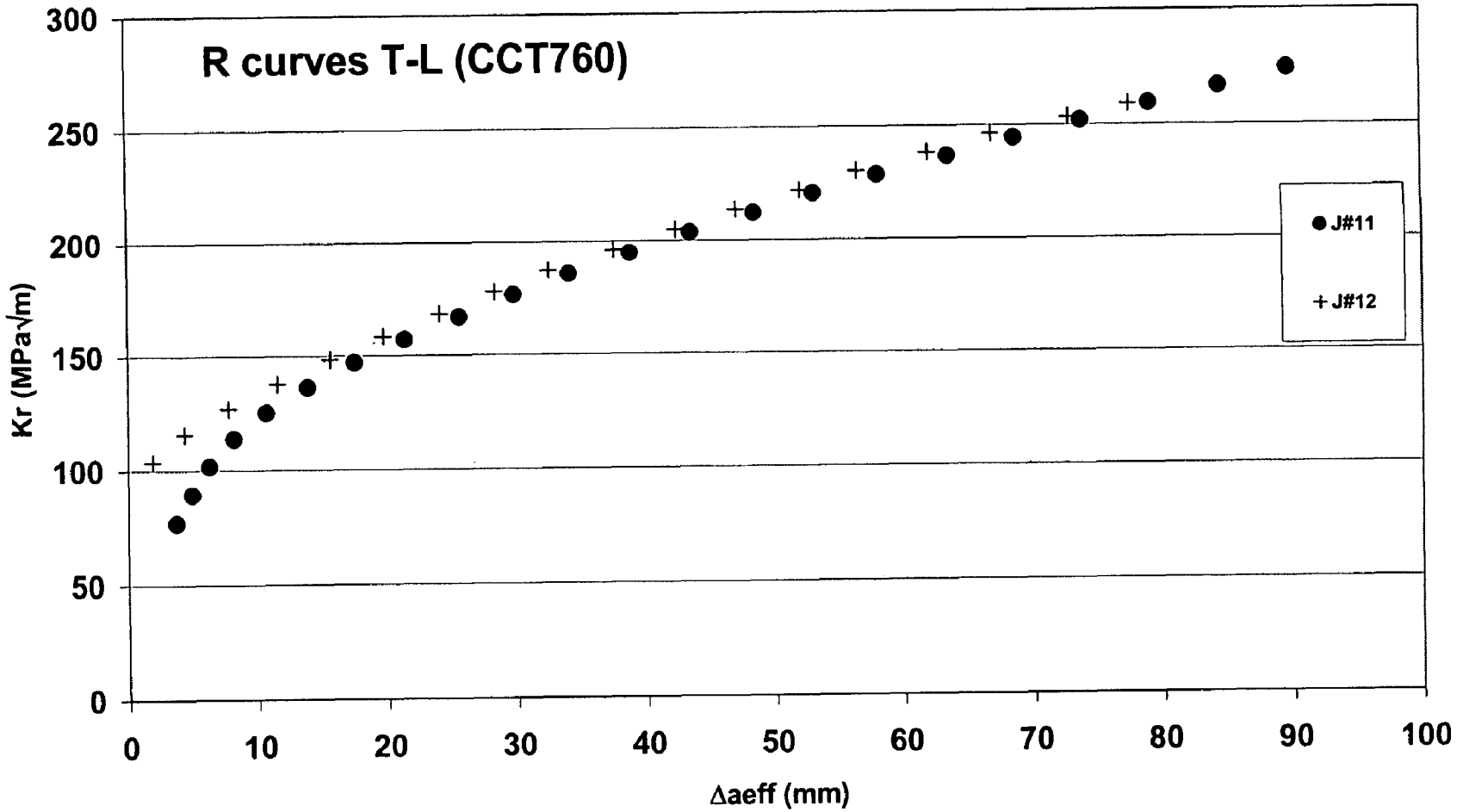

R-curves, obtained for the two samples in the T-L direction are presented in FIG. 5. Table 12 summarizes the results. 1.8% stretched sample exhibited a lower strength than 3.4% stretched sample. Very high toughness was observed for both samples.

TABLE 12

Results of toughness tests of industrial samples with varying stretch.

| | | T-L (760 mm wide specimen) | | | | | | | | | | |
|---|---|---|---|---|---|---|---|---|---|---|---|---|
| | Stretching | $K_{app}$ | $K_{eff}$ | $K_r$(MPa√m) Aa [mm] | | | | | | | | |
| Sample | (%) | (MPa√m) | (MPa√m) | 10 | 20 | 30 | 40 | 50 | 60 | 70 | 80 |
| J#11 | 1.8 | 140 | 220 | 118 | 152 | 177 | 198 | 216 | 232 | 246 | 260 |
| J#12 | 3.4 | 179 | 259 | 135 | 160 | 181 | 199 | 217 | 234 | 250 | 263 |

Example 4

In this example, the mechanical strength of the welded joints of the present invention and reference plates were evaluated. 3.2 mm sheets from casts D (6156), E (2098) and I were welded by friction stir welding. Welding was performed on an MTS ISTIR® Machine. Welding parameters were chosen from tests conducted in a preliminary study. Welding parameters set-up was made according to microstructural inspection and bending test. For sheets from casts E and I, the combinations were made with a tool rotating speed of 800 rpm (rotations per minute) and a welding speed of 300 mm/min. For sheet from cast D, the combinations were made with a tool rotating speed of 510 rpm (rotations per minute) and a welding speed of 900 mm/min.

Aging was carried out either before or after friction stir welding. The results are provided in Table 13. The performance of the welded joints obtained with sheets from the invention were particularly satisfactory on two aspects. First, the joint efficiency coefficient, which is the ratio of ultimate tensile strength between the joint and the non welded sheet, was higher than 70% and even 75% for inventive samples. It even reached 80% in some instances. This was a better result than obtained on a reference joint obtained with sheet from cast E. Second, the results were not greatly influenced by the timing of the aging step (before or after welding) which enables a quite versatile process. To the contrary, for sheets obtained from cast D(6156), a strong influence of the timing of the aging step was observed.

TABLE 13

Mechanical properties of the welded joints.

| Cast | Aging step | Mechanical strength of the joint UTS (MPa) | TYS (MPa) | E (%) | Reference UTS for non welded sheet (MPa) | Joint Efficiency Co-efficient (%) |
|---|---|---|---|---|---|---|
| D | Before welding | 264 | 200 | 2.8 | 372 | 71 |
| D | After welding | 318 | 292 | 1.8 | 372 | 86 |
| E | Before welding | 386 | 269 | 4.9 | 543 | 71 |

TABLE 13-continued

Mechanical properties of the welded joints.

| Cast | Aging step | Mechanical strength of the joint UTS (MPa) | TYS (MPa) | E (%) | Reference UTS for non welded sheet (MPa) | Joint Efficiency Co-efficient (%) |
|---|---|---|---|---|---|---|
| E | After welding | 413 | 309 | 5.6 | 543 | 76 |
| F | Before welding | 385 | 309 | 5.2 | 483 | 80 |
| F | After welding | 377 | 279 | 5.9 | 483 | 78 |

Example 5

In this example, the influence of Zr and Mn content on mechanical strength and toughness was evaluated. Two alloys were cast and transformed to 6 mm thick plates according to the conditions reported for samples G, H and I in Table 4. The compositions of these alloys are provided in Table 14.

TABLE 14

Composition (wt. %) of Mn containing invention alloys

| Cast reference | Si | Fe | Cu | Mn | Mg | Zr | Li | Ag | Ti |
|---|---|---|---|---|---|---|---|---|---|
| L | 0.03 | 0.05 | 3.3 | 0.31 | 0.32 | 0.05 | 0.99 | 0.32 | 0.02 |
| M | 0.03 | 0.05 | 3.3 | 0.30 | 0.33 | 0.11 | 0.98 | 0.35 | 0.02 |

The samples were mechanically tested to determine their static mechanical properties as well as their toughness. Tensile yield strength, ultimate strength and elongation at fracture are provided in Table 15 and toughness is provided in Table 16.

TABLE 15

Static mechanical properties of Mn containing alloys.

| Sample | Thick-ness | L Direction UTS (MPa) | TYS (MPa) | E (%) | LT Direction UTS (MPa) | TYS (MPa) | E (%) |
|---|---|---|---|---|---|---|---|
| L | 6.0 | 479 | 447 | 13.5 | 477 | 419 | 7.8 |
| M | 6.0 | 494 | 464 | 13.7 | 493 | 448 | 13.1 |

TABLE 16

Toughness of Mn containing alloys

| Sample | Thickness (mm) | T-L (760 mm wide specimen) $K_{app}$ (MPa√m) | $K_{eff}$ (MPa√m) | $K_r$(MPa√m) Δa [mm] 10 | 20 | 30 | 40 | 50 | 60 | 70 | 80 |
|---|---|---|---|---|---|---|---|---|---|---|---|
| L | 6.0 | 140 | 174 | 111 | 137 | 155 | 168 | 178 | 187 | 194 | 200 |
| M | 6.0 | 158 | 198 | 123 | 152 | 171 | 186 | 199 | 209 | 219 | 227 |

Samples M and N reach mechanical properties according to the invention for a T8 temper.

In addition, performance in static mechanical strength and toughness were lower for sample L which contained Mn and a low Zr content than for other inventive samples. The inventors believe that the lower performance of sample L was related to a less favorable microstructure characterized in particular by the presence of both recrystallized and unrecrystallized zones (mixed microstructure).

Additional advantages, features and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

As used herein and in the following claims, articles such as "the", "a" and "an" can connote the singular or plural.

In the present description and in the following claims, to the extent a numerical value is enumerated, such value is intended to refer to the exact value and values close to that value that would amount to an insubstantial change from the listed value All documents and standards referred to herein are expressly incorporated herein by reference in their entireties.

What is claimed is:

1. A method for producing an aluminum alloy sheet or a light-gauge plate having high fracture toughness and strength, said method comprising:

a) casting an ingot consisting essentially of 2.7 to 3.4 wt. % Cu, 0.8 to 1.4 wt. % Li, 0.1 to 0.8 wt. % Ag, 0.2 to 0.6 wt. % Mg and at least one grain refiner selected from the group consisting of 0.05 to 0.13 wt. % Zr, 0.05 to 0.8 wt.

% Mn, 0.05 to 0.3 wt. % Cr 0.05 to 0.3 wt % Sc, 0.05 to 0.5 wt. % Hf and 0.05 to 0.15 wt. % Ti, remainder aluminum and unavoidable impurities, with the additional proviso that the amount of Cu and Li is such that Cu(wt. %)+5/3 Li(wt. %)<5.2;

b) homogenizing said ingot at 490-530° C. for a duration from 5 and 60 hours;

c) rolling said ingot to a sheet or a light-gauge plate with a final thickness from 0.8 to 12 mm;

d) solution heat treating and quenching said sheet or light-gauge plate;

e) stretching said sheet or light-gauge plate with a permanent set from 1 to 5%;

f) aging said sheet or light-gauge plate by heating at 140-170° C. for 5 to 30 hours.

2. A method according to claim 1 wherein said final thickness is from 2 to 12 mm.

3. A method according to claim 1 wherein the total cold working deformation after quenching is from 2.5 to 4%.

4. A method according to claim 1 wherein said stretching permanent set is from 2.5 to 4%.

5. A method according to claim 1 wherein said aging comprises heating at 140-155° C. for 10 to 30 hours.

6. A low density aluminum alloy sheet or light-gauge plate produced by the method of claim 1 comprising in a T8 temper (a) a yield strength in the L direction of at least 440 MPa, (b) a plane stress fracture toughness $K_{app}$, measured on CCT760 (2ao=253 mm) specimens, of at least 110 MPa√m in the T-L direction, and (c) a crack extension of the last valid point of the R-curve $\Delta a_{eff\,(max)}$ in the T-L direction of at least 30 mm.

7. A low density aluminum alloy sheet or light-gauge plate produced by the method of claim 1 comprising in a T8 temper (a) a yield strength in the L direction of at least 460 MPa, and (b) a plane stress fracture toughness $K_{app}$ measured on CCT760 (2ao=253 mm) specimens, of at least 130 MPa√m in the T-L direction, and (c) a crack extension of the last valid point of the R-curve $\Delta a_{eff\,(max)}$ in the T-L direction of at least 40 mm.

8. A method for producing an aluminum alloy sheet or light-gauge plate having high fracture toughness and strength, said method comprising:

a) casting an ingot consisting essentially of 3.0 to 3.4 wt. % Cu, 0.8 to 1.2 wt. % Li, 0.2 to 0.5 wt. % Ag, 0.2 to 0.6 wt. % Mg and at least one grain refiner selected from the group consisting of 0.09 to 0.13 wt. % Zr, 0.05 to 0.8 wt. % Mn, 0.05 to 0.3 wt. % Cr 0.05 to 0.3% Sc, 0.05 to 0.5 wt. % Hf and 0.05 to 0.15 wt. % Ti, remainder aluminum and unavoidable impurities, with the additional proviso that the amount of Cu and Li is such that Cu(wt. %)+5/3 Li(wt. %)<5.0;

b) homogenizing said ingot at 490-530° C. for a duration from 5 to 60 hours;

c) rolling said ingot to a 2 to 9 mm final gauge sheet or light-gauge plate;

d) solution heat treating said sheet or light-gauge plate at a temperature from 490 to 530.degree° C. for a duration from 15 minutes to 2 hours, followed by quenching;

e) stretching said sheet or light-gauge plate with a permanent set from 2.5 to 4%;

I) aging said sheet or light-gauge plate by heating at 140-155° C. for 10 to 30 hours.

9. A low density aluminum alloy sheet or light-gauge plate produced by the method of claim 8 comprising in a T8 temper (a) a yield strength in the L direction of at least 440 MPa, (b) a plane stress fracture toughness $K_{app}$, measured on CCT760 (2ao=253 mm) specimens, of at least 110 MP a√m in the T-L direction, and (c) a crack extension of the last valid point of the R-curve $\Delta a_{eff\,(max)}$ in the T-L direction of at least 30 mm.

10. A low density aluminum alloy sheet or light-gauge plate produced by the method of claim 8 comprising in a T8 temper (a) a yield strength in the L direction of at least 460 MPa, and (b) a plane stress fracture toughness $K_{app}$ measured on CCT760 (2ao=253 mm) specimens, of at least 130 MPa√m in the T-L direction, and (c) a crack extension of the last valid point of the R-curve $\Delta a_{eff\,(max)}$ in the T-L direction of at least 40 mm.

11. A method for producing an aluminum alloy sheet or a light-gauge plate having high fracture toughness and strength, said method comprising:

a) casting an ingot consisting essentially of 2.7 to 3.4 wt. % Cu, 0.8 to 1.4 wt. % Li, 0.1 to 0.8 wt. % Ag, 0.2 to 0.6 wt. % Mg, 0.05 to 0.13 wt. % Zr, 0.02 to 0.3 wt % Sc and optionally 0.05 to 0.8 wt. % Mn, 0.05 to 0.3 wt. % Cr, 0.05 to 0.5 wt. % Hf and 0.01 to 0.15 wt. % Ti, remainder aluminum and unavoidable impurities, with the additional proviso that the amount of Cu and Li is such that Cu(wt. %)+5/3 Li(wt. %)<5.2;

b) homogenizing said ingot at 490-530° C. for a duration from 5 to 60 hours;

c) rolling said ingot to a sheet or a light-gauge plate with a final thickness from 0.8 to 12 mm;

d) solution heat treating and quenching said sheet or light-gauge plate;

e) stretching said sheet or light-gauge plate with a permanent set from 1 to 5%;

f) aging said sheet or light-gauge plate by heating at 140-170° C. for 5 to 30 hours.

12. A low density aluminum alloy sheet or light-gauge plate produced by the method of claim 11 comprising in a T8 temper (a) a yield strength in the L direction of at least 440 MPa, (b) a plane stress fracture toughness $K_{app}$, measured on CCT760 (2ao=253 mm) specimens, of at least 110 MPa√m in the T-L direction, and (c) a crack extension of the last valid point of the R-curve $\Delta a_{eff\,(max)}$ in the T-L direction of at least 30 mm.

13. A low density aluminum alloy sheet or light-gauge plate produced by the method of claim 11 comprising in a T8 temper (a) a yield strength in the L direction of at least 460 MPa, and (b) a plane stress fracture toughness $K_{app}$ measured on CCT760 (2ao=253 mm) specimens, of at least 130 MPa√m in the T-L direction, and (c) a crack extension of the last valid point of the R-curve $\Delta a_{eff\,(max)}$ in the T-L direction of at least 40 mm.

14. A rolled, forged and/or extruded aluminum alloy consisting essentially of 2.7 to 3.4 wt. % Cu, 0.8 to 1.4 wt. % Li, 0.1 to 0.8 wt. % Ag, 0.2 to 0.6 wt. Mg and at least one grain refiner selected from the group consisting of 0.05 to 0.13 wt. % Zr, 0.05 to 0.8 wt. % Mn, 0.05 to 0.3 wt. % Cr, 0.05 to 0.3 wt. % Sc, 0.05 to 0.5 wt. % Hf and 0.05 to 0.15 wt. % Ti, remainder aluminum and unavoidable impurities, with the additional proviso that the amount of Cu and Li is such that Cu(wt. %)+5/3 Li(wt. %)<5.2.

15. An alloy of claim 14 wherein said alloy comprises from 3.0 to 3.4 wt. % Cu.

16. An alloy of claim 14 wherein said alloy comprises from 3.1 to 3.3 wt. % Cu.

17. An alloy of claim 14 wherein said alloy comprises from 0.8 to 1.2 wt. % Li.

18. An alloy of claim 14 wherein said alloy comprises from 0.9 to 1.1 wt. wt. % Li.

19. An alloy of claim 14 wherein said alloy comprises from 0.2 to 0.5 wt. % Ag.

20. An alloy according to claim 14 wherein said alloy-comprises from 0.2 to 0.4 wt. % Ag.

21. An alloy according to claim 14 wherein said alloy comprises less than 0.4 wt. % Mg.

22. An alloy according to claim 14 wherein said alloy comprises from 0.09 to 0.13 wt. % Zr.

23. An alloy according to claim 14 wherein said alloy comprises less than 0.05 wt. % Mn.

24. An alloy according to claim 14, with a thickness from 0.8 to 12 mm.

25. An alloy according to claim 24, with a thickness from 2 to 12 mm.

26. A structural member comprising an aluminum alloy of claim 14.

27. A structural member of claim 26 wherein said aluminum alloy is a sheet or light-gauge plate.

28. A structural member of claim 27, wherein said structural member is an aircraft fuselage panel.

29. An alloy of claim 14, comprising in a T8 temper:

(a) a yield strength in the L direction of at least 440 MPa, (b) a plane stress fracture toughness $K_{app}$ measured on CCT760 (2ao=253 mm) specimens, of at least 110 MPa√m in the T-L direction, and (c) a crack extension of the last valid point of the R-curve $\Delta a_{eff\,(max)}$ in the T-L direction of at least 30 mm.

30. A structural member of claim 26, wherein said structural member is a stringer.

31. A structural member of claim 26 comprising a welded construction wherein the joint efficiency coefficient thereof is at least 70%.

32. A structural member of claim 31 wherein said welded construction is welded by friction stir welding.

33. A fuselage panel of claim 28 that has a weight that is from 1-10% lower than an equivalent fuselage panel formed of a 2024, 2056, 2098, 7475 and/or 6156 alloy.

34. A structural member of claim 26 that has a weight that is from 1-10% lower than an equivalent structural member formed of one or more of 2024, 2056, 2098, 7475 and/or 6156 alloys.

* * * * *